US006460524B2

(12) United States Patent
Kimura

(10) Patent No.: US 6,460,524 B2
(45) Date of Patent: Oct. 8, 2002

(54) BLOW-BY GAS SEPARATOR

(75) Inventor: Haruyo Kimura, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/838,229

(22) Filed: Apr. 20, 2001

(65) Prior Publication Data

US 2001/0032635 A1 Oct. 25, 2001

(30) Foreign Application Priority Data

Apr. 24, 2000 (JP) ..... 2000-122460

(51) Int. Cl.[7] ..... F02M 13/00
(52) U.S. Cl. ..... 123/572; 123/573
(58) Field of Search ..... 123/572, 573, 123/574, 41.86

(56) References Cited

U.S. PATENT DOCUMENTS

| | | | | |
|---|---|---|---|---|
| 2,821,174 A | | 1/1958 | Scheiterlein | |
| 4,103,650 A | | 8/1978 | Nishida et al. | |
| 4,353,332 A | | 10/1982 | Sweetland | |
| 4,607,601 A | | 8/1986 | Kehler | |
| 4,825,818 A | | 5/1989 | Hamamura et al. | |
| 4,945,887 A | | 8/1990 | Sakurai et al. | |
| 5,261,380 A | * | 11/1993 | Romano | 123/573 |
| 5,542,402 A | * | 8/1996 | Lee et al. | 123/573 |
| 5,622,156 A | * | 4/1997 | Rose et al. | 123/573 |
| 5,983,873 A | * | 11/1999 | Dellora et al. | 123/572 |
| 6,044,828 A | * | 4/2000 | Matsushita | 123/572 |

* cited by examiner

*Primary Examiner*—Marguerite McMahon
(74) *Attorney, Agent, or Firm*—Antonelli, Terry, Stout & Kraus, LLP

(57) ABSTRACT

A blow-by gas separator, including a separator unit mounted on a front end surface of a cylinder block and having accommodation space for accommodating a drive mechanism that transmits the driving force of the crank shaft of an engine to a driven shaft. The separator unit is provided with a blow-by gas passage chamber formed along the outer peripheral edge of an upper part of the accommodation space, and has formed therein a blow-by gas flow-in port and a blow-by gas flow-out port which are opened in the blow-by gas passage chamber.

6 Claims, 6 Drawing Sheets

BLOW-BY GAS SEPARATOR

FIELD OF THE INVENTION

The present invention relates to a blow-by gas separator for separating and removing oil contained in the blow-by gas of an engine.

DESCRIPTION OF THE PRIOR ART

There has heretofore been known a PCV (positive crankcase ventilation) arrangement for returning blow-by gas, that has leaked into the crank case from a combustion chamber of an engine through a gap between a piston and a cylinder wall, back to the combustion chamber to burn it. The blow-by gas contains unburned gases as well as a lubricating oil which is in an atomized form, and it is necessary to separate and remove the oil. For the purpose of separating and removing the oil, the PCV apparatus is provided with a separator which is usually arranged inside a cylinder head cover. In the PCV apparatus in which the separator is arranged inside the cylinder head cover, the blow-by gas that has leaked into the crank case is guided into the separator through an oil chute passage that is formed in the side portion of the engine body and is opened in the upper surface of the cylinder head. While the blow-by gas thus guided into the separator passes through the separator, the oil is separated and removed therefrom and is recirculated into the intake system through the PCV hose. In the case of a V-type engine, however, separators are each provided in both cylinder head covers on the right and left banks and hence, the PCV hoses must be connected to the two separators and must be put together, resulting in an increase in the number of parts and causing the device to become complex. In order to solve this problem, there has been proposed a PCV apparatus having a separator which is provided in a chain case that covers a timing chain provided at a front end of the engine, as disclosed in Japanese Laid-open Patent Publications (Kokai) Nos. 98924/1993 (JP-A 5-98924) and 47157/1998 (JP-A 10-47157). With the separator being provided in the chain case at the front end of the engine, the blow-by gas that is introduced from the crank case into the separator to separate and remove the oil can be returned back to the intake system through a single PCV hose, solving the above-mentioned problem peculiar to the V-type engines. However, there exist actually a chain, a sprocket, a tensioner and the like in the chain case, and with relation with this fact, limitation is put on a space where the separator is arranged. That is, there exists a problem in that it is not possible to secure space enough for separating and removing the oil. Further, in the chain case, the oil circulates to lubricate the chain. When the blow-by gas flows through the chain case, therefore, the oil in the chain case intermingles with the blow-by gas. Consequently, a problem arises that the oil can be hardly separated and removed from the blow-by gas to a sufficient degree, and so flows into the intake system.

SUMMARY OF THE INVENTION

It is an object of the present invention to provide a blow-by gas separator that can secure space enough for arranging the separator, can reliably separate and remove the oil from the blow-by gas and can prevent the oil from flowing into the intake system.

In order to accomplish the above-mentioned object according to the present invention, there is provided a blow-by gas separator comprising:

a separator unit mounted on a front end surface of a cylinder block and having accommodation space for accommodating a drive mechanism that transmits driving force of the crank shaft of the engine to a driven shaft; wherein the separator unit is provided with a blow-by gas passage chamber formed along the outer peripheral edge of an upper part of the accommodation space, and has formed therein a blow-by gas flow-in port and a blow-by gas flowout port which are opened in the blow-by gas passage chamber.

The separator unit is constituted by a frame member with the accommodation space and a recessed portion, as well as a cover member mounted on the recessed portion of the frame member and having a cover member recessed portion to form the blow-by gas passage chamber in cooperation with the recessed portion of the frame member.

Further, a partitioning plate for partitioning the blow-by gas passage chamber into a blow-by gas flow-in chamber and a blow-by gas flow-out chamber is disposed between the frame member and the cover member. The partitioning plate has a passage port for communicating the blow-by gas flow-in chamber with the blow-by gas flow-out chamber, and a blow-by gas flow-in port is opened in the blow-by gas flow-in chamber and a blow-by gas flow-out port is opened in the blow-by gas flow-out chamber.

It is desired that the blow-by gas flow-in port be formed at an higher location than the passage port of the partitioning plate and that the blow-by gas flow-in chamber be provided with a narrowed portion with a reduced cross section between the blow-by gas flow-in port and the passage port.

Further, the lower part of the blow-by gas flow-out chamber is communicated through an oil drain passage with the accommodation space for accommodating the drive mechanism.

It is further desired that the partitioning plate be made of a metallic gasket material.

Further, the cylinder block has a pair of right and left banks which have offset relation to each other along the direction of the crank shaft, and the cover member is arranged in space produced by the offset of the right and left banks.

DETAILED DESCRIPTION OF THE PREFERRED EMBODIMENTS

Figure 1:
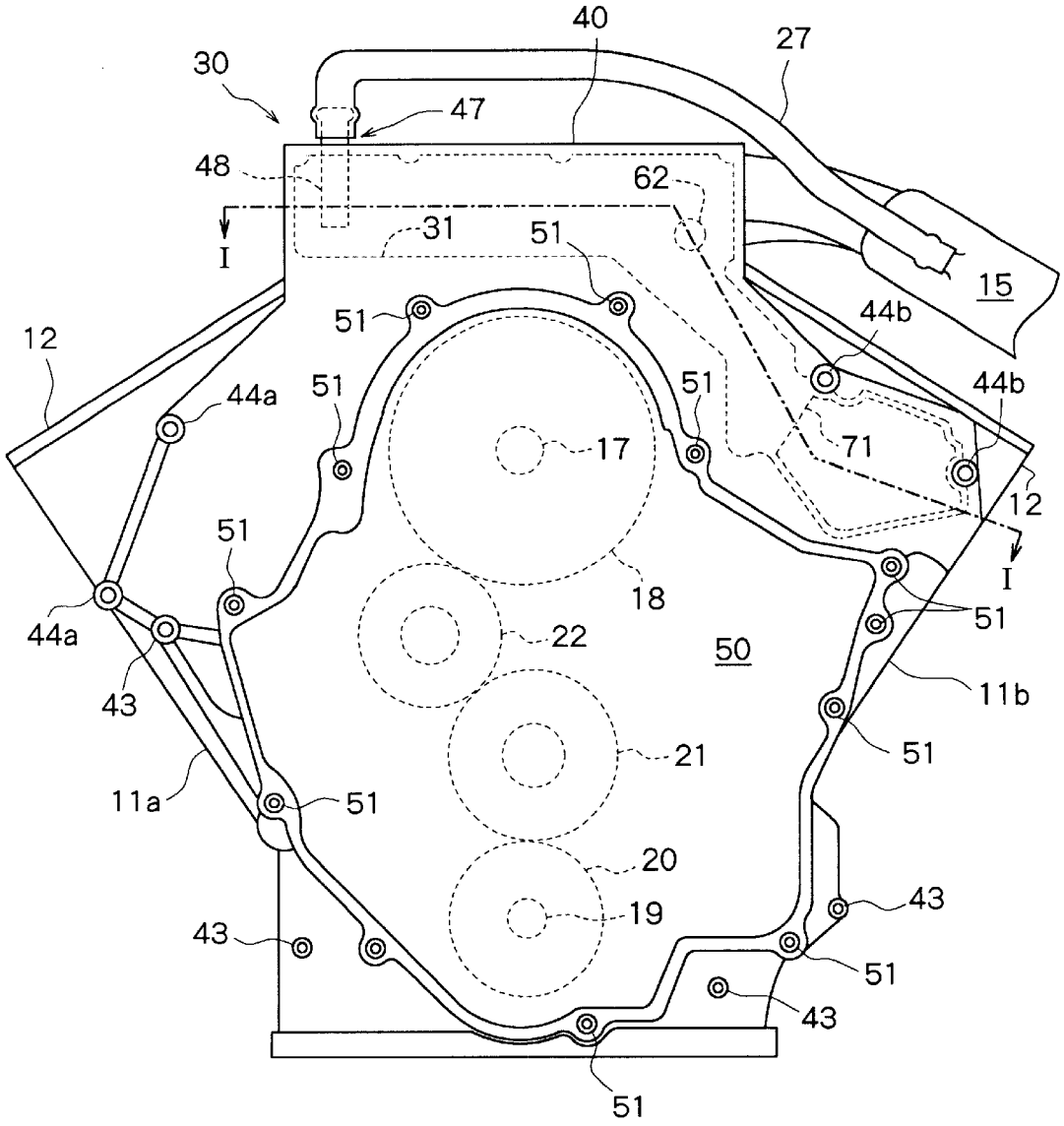
FIG. 1 is a front view of an engine equipped with a blow-by gas separator constituted according to the present invention.

An embodiment of the present invention will now be described with reference to the drawings.

The illustrated embodiment illustrates a case where the present invention is applied to a V-type 6-cylinder engine. In the drawings, reference numeral 10 denotes an engine body which is constituted by a cylinder block 11 and cylinder heads 12, 12. In the illustrated embodiment, the cylinder block 11 is a V-type one in which a pair of right and left banks 11*a* and 11*b* are opposed to each other to form V-banks. Three cylinders are formed in each of the right and left banks 11*a* and 11*b* of the cylinder block 11. The cylinders formed in the right and left banks 11*a* and 11*b* are alternately arranged in the direction of the crank shaft to prevent interference between the connection rods arranged on the crank shaft. Therefore, the right and left banks 11*a* and 11*b* have offset relation to each other by a length T of the offset in the direction of the crank shaft. In the illustrated embodiment, the bank 11*b* on the right side as viewed from the front of the engine body 10 (lower side in FIG. 2) is placed on the rear side of the engine (right side in FIG. 3) by the length T relative to the bank 11*a* of the left side as viewed from the front of the engine body 10.

Figure 2:
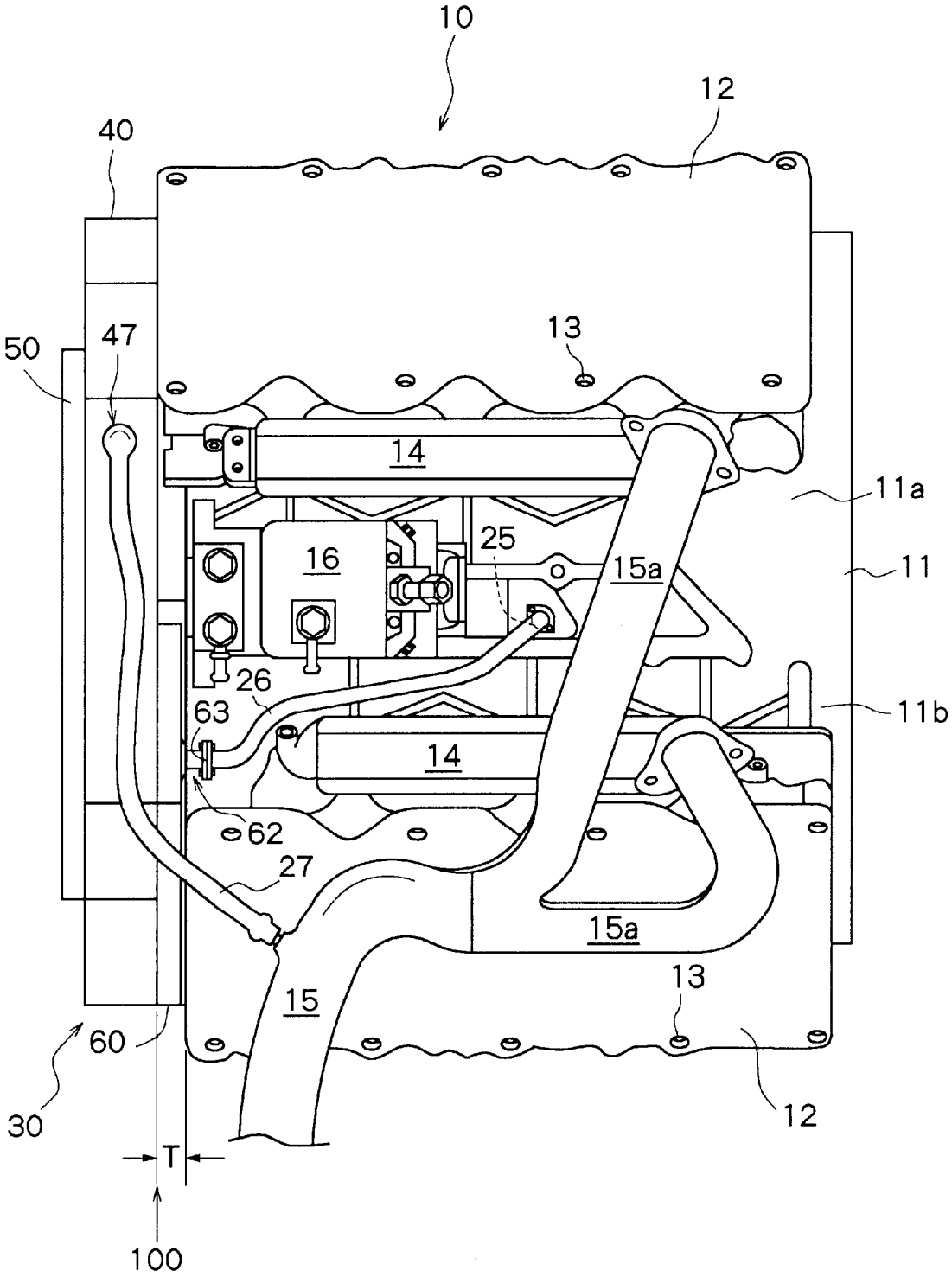
FIG. 2 is a plan view of the engine of FIG. 1.

Referring to FIG. 2, a blow-by gas discharge port 25 is provided at a central portion between the V-banks of the cylinder block 11 constituted as described above. The blow-by gas discharge port 25 is communicated with a blow-by gas discharge passage (not shown) that is opened in the crank case of the cylinder block 11. Therefore, the blow-by gas filled in the crank case is sent to a separator that will be described later, from the blow-by gas discharge port 25 through the blow-by gas discharge passage that is not shown.

Cylinder heads 12, 12 are located on the upper surfaces of the right and left banks 11*a* and 11*b* that constitute the cylinder block 11. Head bolt holes 13 are formed in the cylinder heads 12 and 12 along the periphery thereof, and head bolts that are not shown are inserted in the head bolt holes 13 and are screwed into threaded holes formed in the right and left banks 11*a* and 11*b*, so that the cylinder heads 12 and 12 are fastened to the cylinder block 11. Intake manifolds 14 and 14 are arranged on the opposing inner sides of the cylinder heads 12 and 12. Ends on one side of the intake manifolds 14 and 14 are coupled to intake ports (not shown) that are opened in the cylinder heads 12 and 12, and ends on the other side thereof are coupled to intake branch pipes 15*a* and 15*a*. The two intake branch pipes 15*a* and 15*a* are put together into one so as to be coupled to an intake pipe 15.

Between the V-banks of the engine body 10 constituted by the cylinder block 11 and the cylinder heads 12, 12, there is arranged a fuel injection pump 16 at a front end thereof (left end in FIG. 2). The fuel injection pump 16 raises the pressure of the fuel fed, by a feed pump, from a fuel tank that is not shown, and feeds this high-pressure fuel to fuel injection nozzles disposed in the cylinders. A drive shaft 17 of the fuel injection pump 16 is disposed protruding forward beyond a front end surface 100 of the engine body 10. A pump gear 18 is attached to an end of the rive shaft 17. A crank shaft 19 arranged in a lower part of the cylinder block 11, too, and protrudes forward beyond the front end surface 100 of the engine body 10, and a crank gear 20 is attached to an end thereof. Two idler gears 21 and 22 are arranged between the crank gear 20 and the pump gear 18 to be in mesh with two gears, whereby the crank gear 20 is coupled to the pump gear 18 through this gearing. Thus, the crank gear 20, idler gears 21, 22 and pump gear 18 constitute a drive mechanism for transmitting the driving force of the crank shaft 19 to the drive shaft 17, which is a driven shaft, of the fuel injection pump 16.

A separator unit 30 is mounted on the front end surface 100 of the engine body 10 to constitute a blow-by gas separator.

The separator unit 30 has a frame member 40. The frame member 40 will now be described with reference chiefly to FIG. 3. The frame member 40 is constituted by a plate-like member formed of, for example, an aluminum alloy and having a predetermined thickness. The frame member 40 is formed in a shape nearly in agreement with the shape of the front end surface 100 of the engine body 10 and has a central portion which protrudes upward. In the thus formed frame member 40 is further formed an accommodation space 41 in which is arranged the drive mechanism that transmits the driving force of the crank shaft 19 to the drive shaft 17, which is the driven shaft, of the fuel injection pump 16, i.e., in which are arranged the crank gear 20, idler gears 21, 22 and pump gear 18. The accommodation space 41 is constituted by a vertically elongated nearly elliptic hole from the lower part of the frame member 40 toward the central part thereof. The crank gear 20, idler gears 21, 22 and pump gear 18 are arranged in the accommodation space 41 at a positional relationship shown by two-dot chain lines in FIG. 3 in a state where the separator unit 30 is mounted on the front end surface 100 of the engine body 10. A protection wall 42 is formed hanging from the upper part of the accommodation space 41 on the side of the rear end surface of the frame member 40 (front side in FIG. 3). The protection wall 42 is provided to prevent the oil that lubricates the gears constituting the drive mechanism for the fuel injection pump 16 from flying in a direction between the V-banks of the cylinder block 11. Therefore, the upper part of the accommodation space 41 is closed by the protection wall 42 on the side of the rear end surface, and a space defined on the front side of the protection wall 42 (back side in FIG. 3) provides a space for part of the pump gear 18.

The frame member 40 has a plurality of frame member-mounting bosses 43, 44 for fastening it to the engine body 10 by using fastening bolts. The frame member-mounting bosses 43 corresponding to the cylinder block 11 are formed along the outer peripheral edge of the accommodation space 41 and along the lower end of the protection wall 42. On the other hand, the frame member-mounting bosses 44 corresponding to the cylinder heads 12,12 are formed along the outer peripheral edge of the frame member 40. The frame member-mounting bosses 44 include frame member-mounting bosses 44*a* formed at portions corresponding to the cylinder head 12 of the left side (right side in FIG. 3) as viewed from the front of the engine body 10 and frame member-mounting bosses 44*b* formed at portions corresponding to the cylinder head 12 of the right side (left side in FIG. 3). Bolt insertion holes are formed in these frame member-mounting bosses 43, 44*a* and 44*b*.

On the back surface of the frame member 40, a junction portion 45 is provided along the outer peripheral edge of the accommodation space 41 and along the lower end edge of the protection wall 42. A slender groove is formed along the outer peripheral edge of the accommodation space 41 and along the lower end edge of the protection wall 42 in the junction portion 45, and a sealing member of rubber or the like is fitted in the groove. When the separator unit 30 is mounted on the engine body 10, the sealing member prevents the oil that lubricates the gears constituting the drive mechanism for the fuel injection pump 16 from leaking to the outer side through a gap between the separator unit 30 and the cylinder block 11.

As described above, the accommodation space 41 is formed in the frame member 40. In the illustrated embodiment, a front cover 50 is mounted on the front surface of the accommodation space 41 as shown in FIGS. 1 and 2. The front cover 50 is formed of a plate member of, for example, an aluminum alloy having a thickness less than that of the frame member 40 and is formed in a shape that meets the outer peripheral edge of the accommodation space 41. The front cover 50 has a plurality of mounting bosses 51 formed along the peripheral edge thereof, the plural mounting bosses 51 having insertion holes for fastening the front cover 50 to the frame member 40 by using the fastening bolts. The peripheral edge of the front cover 50 is overlapped on the outer peripheral edge of the accommodation space 41 of the frame member 40, the fastening bolts are inserted in the insertion holes formed in the mounting bosses 51, and the fastening bolts are screwed into threaded holes (not shown) formed in the outer peripheral edge of the accommodation space 41 of the frame member 40 to mount the front cover 50 on the front surface of the accommodation space 41 of the frame member 40. Therefore, the front cover 50 is so mounted on the front surface of the accommodation space 41 formed in the frame member 40 as to serve as a closure. The front cover 50 that is mounted on the front surface of the accommodation space 41 of the frame member 40, covers the crank gear 20, idler gears 21, 22 and pump gear 18 constituting the drive mechanism of the fuel injection pump 16 accommodated in the accommodation space 41.

In the illustrated embodiment, the front cover 50 which is a separate member is mounted on the front surface of the accommodation space 41 in the frame member 40. However, the accommodation space 41 may be formed by a member formed as a unitary structure which includes the frame member 40 and the front cover 50. Further, an aluminum alloy is used as a material of the frame member 40 and the front cover 50 from the standpoint of reducing the weight. Not being limited to the aluminum alloy, however, there may be used iron-based metal or other metal materials.

Figure 3:
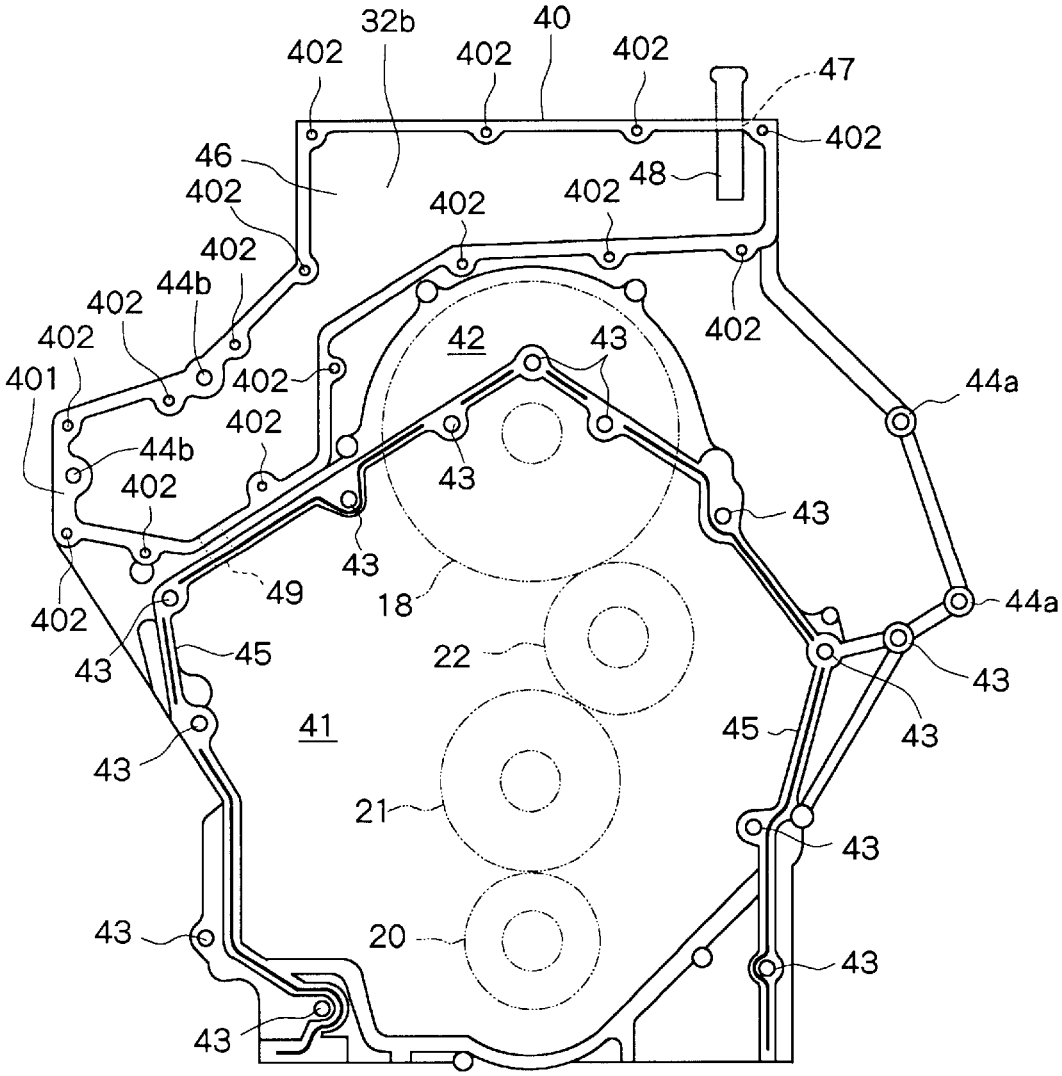
FIG. 3 is a back view of a frame member that forms a part of the blow-by gas separator in the engine of FIG. 1.
Figure 6:
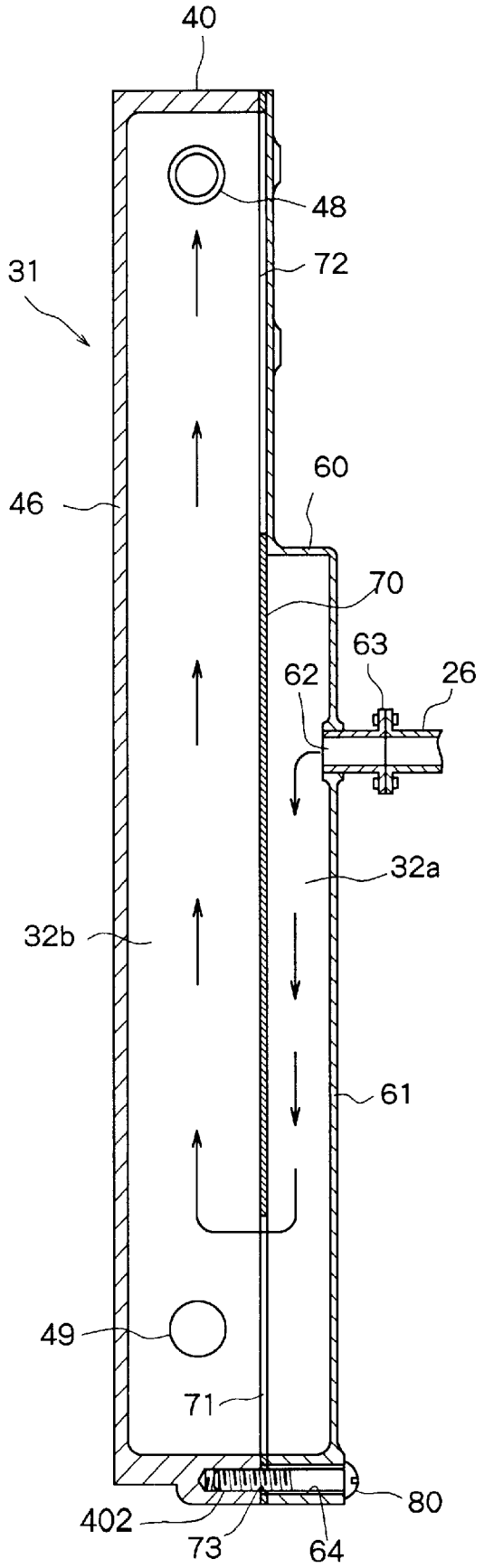
FIG. 6 is a sectional view along the line I—I in FIG. 1.

Referring to FIG. 3, the frame member 40 having the accommodation space 41 for accommodating the drive mechanism, is provided with a recessed portion 46 that constitutes a blow-by gas passage chamber 31 of the separator on the upper side of the accommodation space 41. The recessed portion 46 is formed along the outer peripheral edge in the upper part of the accommodation space 41. In the illustrated embodiment, the recessed portion 46 is formed like a belt from the left upper part to the central upper part as viewed from the back surface (from the left upper part to the central upper part in FIG. 3). In FIG. 3, the recessed portion 46 is horizontal on the right side and is tilted down on the left side. Referring to FIG. 6, further, the recessed portion 46 is open on the rear surface side of the frame member 40 (right side in FIG. 6) and has nearly a constant depth.

The frame member 40 has a cover member-mounting seat 401 that serves as a seat surface for mounting a cover member 60 along the outer peripheral edge of the recessed portion 46. The cover member mounting seat will be described late with reference to FIG. 4. The cover member-mounting seat 401 is formed on the side of the rear end surface of the frame member 40, i.e., on the side of the open surface of the recessed portion 46. The cover member-mounting seat 401 has plural cover member-mounting bosses 402 with threaded holes, and the cover member 60 is mounted on the cover member-mounting bosses 402 by using the fastening bolts. The above-mentioned frame member-mounting bosses 44*b*, too, are formed in the cover member-mounting seat 401.

Figure 4:
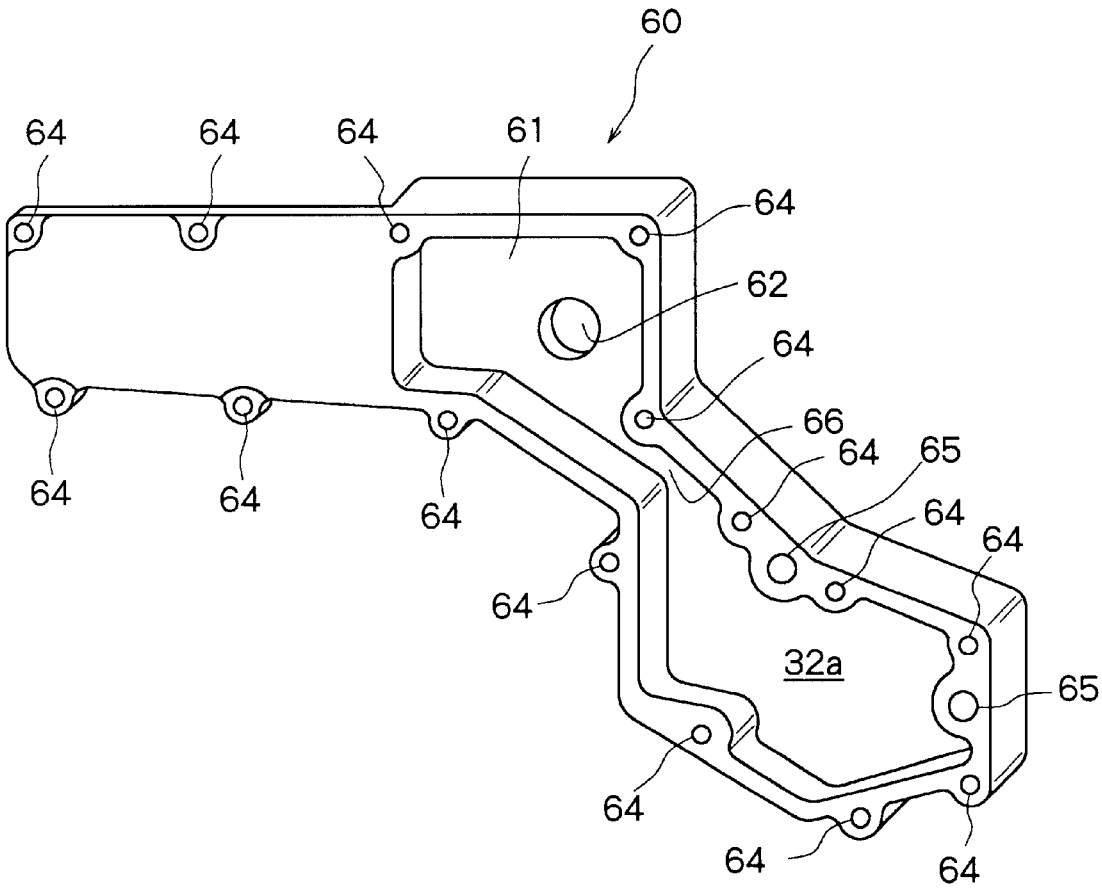
FIG. 4 is a perspective view of a cover member that forms a part of the blow-by gas separator in the engine of FIG. 1.

Turning to FIG. 4, the cover member 60 mounted on the cover member-mounting seat 401 of the frame member 40 has a recessed portion 61. The blow-by gas passage chamber 31 is constituted by the recessed portion 61 in the cover member 60 and by the recessed portion 46 in the frame member 40. A partitioning plate 70, shown in FIG. 5, having a passage port 71 is disposed between the frame member 40 and the cover member 60. The partitioning plate 70 partitions the blow-by gas passage chamber 31 into a blow-by gas flow-in chamber 32*a* and a blow-by gas flow-out chamber 32*b*, and the passage port 71 communicates the blow-by gas flow-in chamber 32*a* with the blow-by gas flow-out chamber 32*b*.

The cover member 60 having the recessed portion 61 will now be described with reference to FIGS. 4 and 6. The cover member 60 is formed of, for example, an aluminum die casting. The cover member 60 has plural mounting portions 64 for mounting it on the cover member-mounting seat 401 of the frame member 40. The mounting portions 64 corresponding to the cover member-mounting bosses 402 formed in the cover member-mounting seat 401 of the frame member 40 are formed along the outer peripheral edge of the cover member 60 and have holes for inserting the fastening bolts. Fastening bolts 80 are inserted in the holes and are screwed into the threaded holes formed in the cover member-mounting bosses 402 of the frame member 40, thereby to mount the cover member 60 on the frame member 40. The cover member 60 has bolt insertion holes 65 which, when the separator unit 30 is mounted on the front end surface 100 of the engine body 10, permit the insertion of the fastening bolts which are also inserted in the frame member-mounting bosses 44*b* of the frame member 40 so as to be fastened to the cylinder head 12. The cover member 60 is further provided with a blow-by gas flow-in port 62 (see also FIG. 1) opened in the blow-by gas passage chamber 32*a* at a position above the passage port 71 formed in the partitioning plate 70. A joint flange 63 is attached on the blow-by gas flow-in port 62 and, as shown in FIG. 2, the blow-by gas flow-in port 62 and the blow-by gas discharge port 25 are communicated with each other via a pipe 26 connected to the joint flange 63. Further, the blow-by-gas flow-in chamber 32*a* formed by the recessed portion 61 and the partitioning plate 70 is provided with a narrowed portion 66 having a reduced cross section between the blow-by gas flow-in port 62 and the passage port 71. The thus constituted cover member 60, in a state of being mounted on the frame member 40, is placed in a space formed by the offset T of the right and left banks 11*a* and 11*b* of the cylinder block 11 that form part of the engine body 10.

Figure 5:
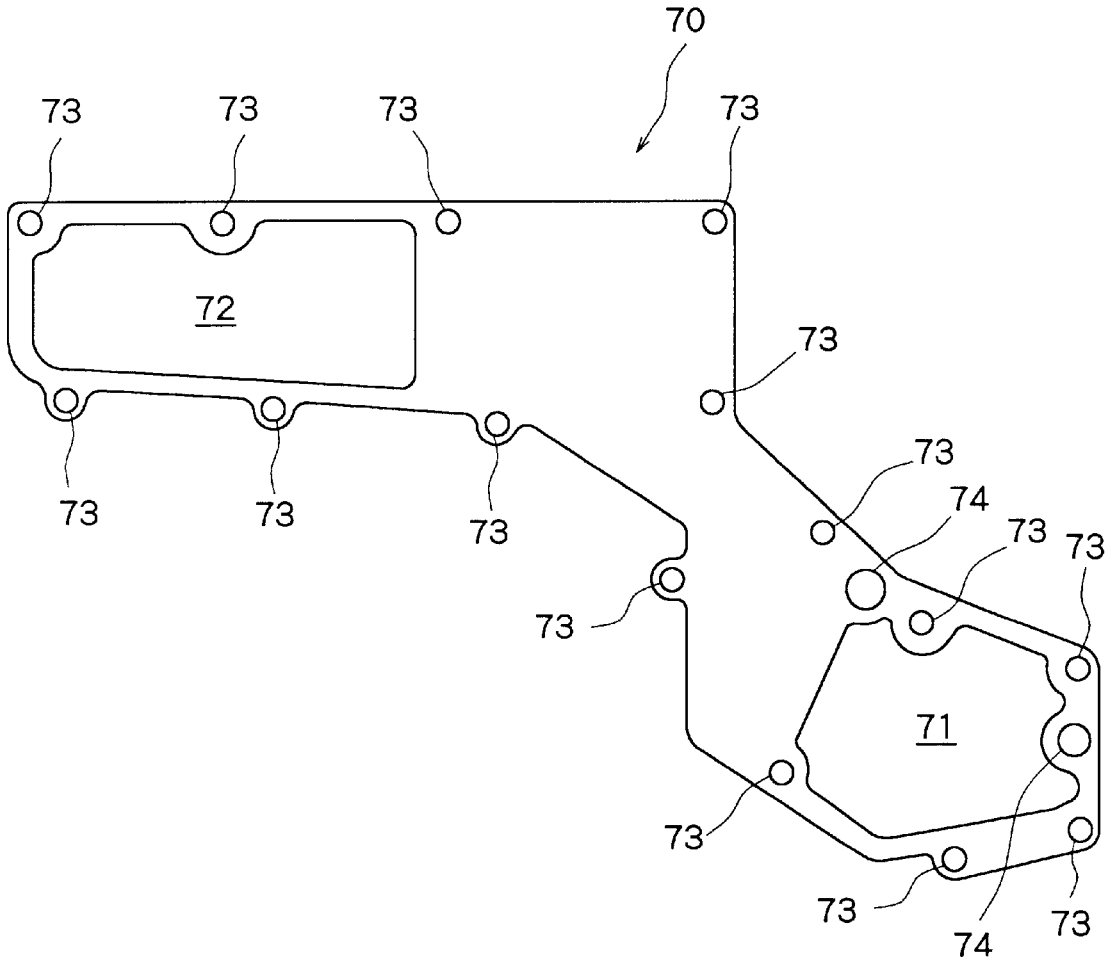
FIG. 5 is a front view of a partitioning plate that forms a part of the blow-by gas separator in the engine of FIG. 1.

Next, the partitioning plate 70 for partitioning the blow-by gas passage chamber 31 into the blow-by gas flow-in chamber 32*a* and the blow-by gas flow-out chamber 32*b*, will be described with reference to FIGS. 5 and 6.

In the illustrated embodiment, the partitioning plate 70 is constituted by a sheet-like member which is a metallic gasket material. The partitioning plate 70 has a shape that meets the recessed portion 46 of the frame member 40. The passage port 71 is formed in the partitioning plate 70 in the right lower portion thereof in FIG. 5. Therefore, the blow-by gas flow-in chamber 32*a* and the blow-by gas flow-out chamber 32*b*, partitioned by the partitioning plate 70, are communicated with each other through the passage port 71. The partitioning plate 70 has a plurality of bolt insertion holes 73 formed in the outer peripheral edge portion thereof for allowing insertion of the fastening bolts 80. The fastening bolts 80 are inserted in the bolt insertion holes 73 to firmly hold the partitioning plate 70 between the frame member 40 and the cover member 60. The partitioning plate 70 has bolt insertion holes 74 in the outer peripheral edge portion thereof which, when the separator unit 30 is mounted on the front end surface 100 of the engine body 10, permit the insertion of the fastening bolts which are also inserted in the frame member-mounting bosses 44*b* of the frame member 40 so as to be fastened to the cylinder head 12. The partitioning plate 70 in the illustrated embodiment further has an opening 72 in a portion not corresponding to the recessed portion 61 of the cover member 60, in order to reduce the weight.

Referring to FIGS. 3 and 6, the frame member 40 is provided with a blow-by gas flow-out port 47 opened at an upper position in the blow-by gas flow-out chamber 32*b* defined by the recessed portion 46 and the partitioning plate 70. A hose connection member 48 is fitted to the blow-by gas flow-out port 47 and, as shown in FIGS. 1 and 2, the blow-by gas flow-out port 47 is communicated with the intake pipe 15 via the PCV hose 27 connected to the hose connection member 48. In the frame member 40 is further formed an oil drain passage 49 for communicating a lower part of the blow-by gas flow-out chamber 32*b* with the accommodation space 41. The oil drain passage 49 is provided for draining the oil separated from the blow-by gas in the blow-by gas passage chamber 31 as will be described later.

The blow-by gas separator according to the illustrated embodiment is constituted as described above, and its operation will now be described.

The blow-by gas filled in the crank case of the cylinder block 11 is discharged from the blow-by gas discharge port 25 formed between the V-banks of the cylinder block 11, and flows into the blow-by gas flow-in chamber 32*a* that constitutes the separator via the pipe 26. The blow-by gas that has flowed into the blow-by gas flow-in chamber 32*a* comes in contact with the partitioning plate 70 and is deflected downward as shown in FIG. 6. The blow-by gas that flows down through the blow-by gas flow-in chamber 32*a* increases its velocity of flow when it passes through the narrowed portion 66, and flows down to the lower end. The blow-by gas flowing down toward the lower end of the blow-by gas flow-in chamber 32*a* is guided into the blow-by gas flow-out chamber 32*b* through the passage port 71 formed at the lower end of the partitioning plate 70. At this moment, the blow-by gas greatly changes its direction. While the direction is being changed, the oil having a large mass, that is contained in the blow-by gas, adheres to the wall on the lower side of the recessed portion 61 constituting the blow-by gas flow-in chamber 32*a* due to its inertia force, and is separated. The oil is thus separated by the inertia force at the time when the blow-by gas changes its direction. In this embodiment in which the blow-by gas increases its velocity of flow at the time of passing through the narrowed portion 64 as described above, therefore, an increased effect of separation is exhibited.

The blow-by gas from which the oil is separated as described above flows into the blow-by gas flow-out chamber 32*b* and, then, flows upward toward the blow-by gas flow-out port 47. The blow-by gas is then sent into the intake pipe 15 through the hose connection member 48, fitted to the blow-by gas flow-out port 47, and the PCV hose 27. The oil separated from the blow-by gas flows into the blow-by gas flow-out chamber 32*b* through the communication port 71 formed at the lower end of the partitioning plate 70, and is drained to the accommodation space 41 through the oil drain passage 49 that communicates the accommodation space 41 with the lower part of the recessed portion 46 constituting the blow-by gas flow-out chamber 32*b*. The oil separated from the blow-by gas needs to be returned back to the lubrication system, and the oil drained into the accommodation space 41 through the oil drain passage 49 functions as a lubricating oil for the gears constituting the drive mechanism accommodated in the accommodation space 41.

The blow-by gas separator according to the illustrated embodiment is constituted as described above, and the blow-by gas passage chamber 31 formed in the separator unit 30, having the accommodation space 41 for accommodating the drive mechanism, is formed along the outer peripheral edge of the upper portion of the accommodation space 41. Accordingly, the blow-by gas passage chamber 31 can be freely defined without imposing any limitation on the space for passing the blow-by gas. Thus, the blow-by gas passage chamber 31 secures space large enough for separating the oil contained in the blow-by gas, and the blow-by gas can be directly introduced from the blow-by gas flow-in port 62 without passing through the accommodation space accommodating the drive mechanism in which the oil is splashed. In the illustrated embodiment, further, the blow-by gas passage chamber 31 is constituted by the recessed portion 46 formed in the frame member 40 and by the recessed portion 61 formed in the cover member 60, making it easy to form a space for flowing the blow-by gas. Further, the partitioning plate 70 having the passage port 71 is disposed between the frame member 40 and the cover member 60 to partition the blow-by gas passage chamber 31 into the blow-by gas flow-in chamber 32*a* and the blow-by gas flow-out chamber 32*b* and to communicate the blow-by gas flow-in chamber 32*a* with the blow-by gas flowout chamber 32*b*. Besides, the blow-by gas flow-in port 62 is located at a location above the passage port 71. Accordingly, the blow-by gas that flows in through the blow-by gas flow-in port 62 flows downward as described above, greatly changes its direction, and is introduced into the blow-by gas flow-out chamber 32*b* by passing through the passage port 71, so that the oil, having a large mass, contained in the blow-by gas is reliably separated due to inertia force. In the illustrated embodiment, further, the partitioning plate 70 is constituted by the sheet-like member which is a metallic gasket material, and, hence, there is no need of providing a sealing gasket along the partitioning plate 70, the frame member 40 and the cover member 60. In the illustrated embodiment, further, the cover member 60, that constitutes the blow-by gas passage chamber 31, is placed in a space formed by the offset T of the right and left banks 11*a* and 11*b* of the cylinder block 11, and, hence, the blow-by gas passage chamber 31 can be formed by effectively utilizing this vacant space.

Though the invention was described above based upon the illustrated embodiment, it should be noted that the invention is in no way limited to the above embodiment only. In the illustrated embodiment, the drive mechanism for transmitting the driving power of the crank shaft to the driven shaft was the gear-type drive mechanism for driving the driven shaft of the fuel injection pump. However, the drive mechanism may be a cam shaft, an oil pump or a water pump, and a system of driving the drive mechanism may be a belt or a chain. Further, the recessed portion of the frame member constituting the blow-by gas passage chamber may be formed in the front surface of the frame member instead of in the back surface. The blow-by gas flow-in port was formed in the cover member and the blow-by gas flow-out port was formed in the frame member. These arrangements, however, may be reversed. In the illustrated embodiment, the narrowed portion formed in the cover member had the reduced sectional area of the blow-by gas passage space formed by narrowing the width of the recessed portion in the cover member. The sectional area, however, may be reduced by changing the depth of the recessed portion or by protruding the partitioning plate toward the cover member. Thus, the present invention may be put into practice in any form of embodiment, provided that it is equipped with the requirements that constitute the present invention and exhibits the same action as that of the present invention.

The blow-by gas separator of the present invention comprises a separator unit which is mounted on the front end surface of the cylinder block and has accommodation space for accommodating a drive mechanism that transmits the driving force of the crank shaft of an engine to a driven shaft, and the separator unit is provided with a blow-by gas passage chamber formed independently along the outer peripheral edge of the accommodation space. Accordingly, it is possible to secure a sufficiently wide space in the separator and to reliably separate and remove oil from the blow-by gas.

What is claimed is:

1. A blow-by gas separator comprising:

a separator unit mounted on a front end surface of a cylinder block, said separator unit having accommodation space for accommodating a drive mechanism that transmits the driving force of the crank shaft of an engine to a driven shaft; wherein:

said separator unit is provided with a blow-by gas passage chamber formed along the outer peripheral edge of an upper part of the accommodation space, and has formed therein a blow-by gas flow-in port and a blow-by gas flow-out port which are opened in said blow-by gas passage chamber, wherein:

said separator unit comprises a frame member, including the accommodation space and a frame member recessed portion, and a cover member, mounted on said recessed portion of said frame member and having a cover member recessed portion which cooperates with said frame member recessed portion to form said blow-by gas passage chamber;

a partitioning plate having a passage port is disposed between said frame member and said cover member to partition said blow-by gas passage chamber into a blow-by gas flow-in chamber and a blow-by gas flow-out chamber, said passage port communicates said blow-by gas flow-in chamber with said blow-by gas flow-out chamber, a blow-by gas flow-in port is opened in said blow-by gas flow-in chamber, and a blow-by gas flow-out port is opened in said blow-by gas flow-out chamber.

2. A blow-by gas separator according to claim 1, wherein said blow-by gas flow-in port is formed at a location above said passage port of said partitioning plate.

3. A blow-by gas separator according to claim 1, wherein said blow-by gas flow-in chamber includes a narrowed portion having a reduced cross section between said blow-by gas flow-in port and said passage port.

4. A blow-by gas separator according to claim 1, wherein the lower part of said blow-by gas flow-out chamber is communicated through an oil drain passage with said accommodation space.

5. A blow-by gas separator according to claim 1, wherein said partitioning plate is made of a metallic gasket material.

6. A blow-by gas separator according to claim 1, wherein the cylinder block includes a pair of right and left banks which are offset relative to each other along the direction of the crank shaft, and said cover member is arranged in a space produced by the offset of the right and left banks.

* * * * *